US009447600B2

(12) United States Patent
Walker

(10) Patent No.: US 9,447,600 B2
(45) Date of Patent: Sep. 20, 2016

(54) POLE MOUNTING SYSTEM

(71) Applicant: GLP DUNDAS INC, Dundas, Ontario (CA)

(72) Inventor: David Eric Walker, Dundas (CA)

(73) Assignee: GLP DUNDAS INC., Dundas, Ontario (CA)

( * ) Notice: Subject to any disclaimer, the term of this patent is extended or adjusted under 35 U.S.C. 154(b) by 0 days.

(21) Appl. No.: 14/938,455

(22) Filed: Nov. 11, 2015

(65) Prior Publication Data

US 2016/0060891 A1 Mar. 3, 2016

Related U.S. Application Data

(63) Continuation of application No. 14/039,986, filed on Sep. 27, 2013, now Pat. No. 9,212,501.

(51) Int. Cl.

| | |
|---|---|
| ***A01K 97/10*** | (2006.01) |
| ***A45B 25/28*** | (2006.01) |
| ***A47G 25/12*** | (2006.01) |
| ***A47G 33/12*** | (2006.01) |
| ***H01Q 1/12*** | (2006.01) |
| ***E04H 12/22*** | (2006.01) |

(Continued)

(52) U.S. Cl.

CPC ..... *E04H 12/2269* (2013.01); *E04H 12/2238* (2013.01); *E04H 12/347* (2013.01); *A45B 2023/0025* (2013.01)

(58) Field of Classification Search

CPC ..... E04H 12/2269; E04H 12/2253; E04H 12/2238; E04H 12/2292; E04H 12/2261; E04H 12/22; E02D 27/42; Y10T 403/7005; F16M 13/02; F16B 21/04

See application file for complete search history.

(56) References Cited

U.S. PATENT DOCUMENTS

| | | | |
|---|---|---|---|
| 3,074,239 | A | 1/1963 | Mustard |
| 3,713,262 | A | 1/1973 | Jatcko |

(Continued)

FOREIGN PATENT DOCUMENTS

| | | |
|---|---|---|
| CA | 2151124 | 4/1995 |
| CA | 2269940 | 10/2000 |

(Continued)

OTHER PUBLICATIONS

Written Opinion and International Search Report dated Dec. 22, 2014 for PCT/CA2014/000708.

*Primary Examiner* — Brian Mattei

(74) *Attorney, Agent, or Firm* — Pillsbury Winthrop Shaw Pittman, LLP

(57) ABSTRACT

A pole mounting system comprises a support mounting and a pole base. The support mounting has a receiving aperture that tapers conically inwardly from a receiving aperture, and at least one helical guide channel is formed in a wall of the receiving recess and extends axially away from the receiving aperture. Each guide channel has a terminal reverse bend. The pole base has an insertion end tapering conically inwardly toward a tip thereof and having guide post(s) extending laterally therefrom. The insertion end and the receiving recess are of complementary shape. The insertion end of the pole base is inserted into the receiving recess with each guide post aligned with the entrance of a corresponding guide channel and rotated in one direction and then the other to drive the guide post(s) along the guide channel(s) until the outer surface of the insertion end engages the wall of the receiving recess.

7 Claims, 19 Drawing Sheets

(51) Int. Cl.
*E04H 12/34* (2006.01)
*A45B 23/00* (2006.01)

(56) References Cited

U.S. PATENT DOCUMENTS

| | | | | |
|---|---|---|---|---|
| 5,125,607 | A | 6/1992 | Pryor | |
| 5,219,419 | A * | 6/1993 | Prothe | A47G 19/23 206/515 |
| 5,524,855 | A | 6/1996 | Lesar | |
| 5,906,077 | A | 5/1999 | Andiarena | |
| 5,915,482 | A | 6/1999 | Carruthers | |
| 6,328,285 | B1 | 12/2001 | Wiseman | |
| 6,379,076 | B1 | 4/2002 | Reinhold et al. | |
| 7,153,064 | B2 | 12/2006 | Zeilinger et al. | |
| 7,156,357 | B1 | 1/2007 | Kocur | |
| 2004/0070985 | A1 | 4/2004 | Haddad et al. | |
| 2004/0200941 | A1 * | 10/2004 | Dennis | B60N 3/102 248/311.2 |
| 2007/0108363 | A1 | 5/2007 | Metheny | |
| 2007/0108364 | A1 | 5/2007 | Metheny | |
| 2009/0314910 | A1 | 12/2009 | Jeanveau | |
| 2011/0110716 | A1 | 5/2011 | Slater et al. | |
| 2011/0113558 | A1 | 5/2011 | Olszewski | |
| 2012/0107469 | A1 * | 5/2012 | Sands | A23L 1/296 426/383 |
| 2012/0132779 | A1 | 5/2012 | Johnson et al. | |

FOREIGN PATENT DOCUMENTS

| | | |
|---|---|---|
| DE | 202007014789 | 12/2007 |
| EP | 1724416 A2 | 11/2006 |
| WO | WO 99/24672 | 5/1999 |
| WO | WO 2006/090156 | 8/2006 |

* cited by examiner

POLE MOUNTING SYSTEM

CROSS-REFERENCE TO RELATED APPLICATIONS

This application is a continuation of U.S. application Ser. No. 14/039,986, filed Sep. 27, 2013, the entire contents of which are incorporated herein by reference in its entirety.

TECHNICAL FIELD

The present disclosure relates to pole mounting systems, and more particularly to pole mounting systems enabling poles to be removably and selectively mounted.

BACKGROUND

There are a wide variety of applications for which the removable mounting of poles is desirable. For example, it may be desirable to position a deck umbrella at various locations around a deck or swimming pool.

U.S. Patent Application Publication No. 2012/0132779 (Johnson et al.) describes an umbrella mounting system in which a plurality of open cylindrical bases are mounted at various locations around a dock or deck, so that a deck umbrella can be repositioned to provide the most effective shade at a given time of day. The base of the deck umbrella is secured within an inner cylindrical sleeve, which is in turn secured within an outer cylindrical sleeve which can be received by one of the cylindrical bases. Although this arrangement allows the deck umbrella to be easily repositioned, no mechanism is provided for securing the outer cylindrical sleeve within the open cylindrical base, and wind beyond a certain force may lift the umbrella out of the open cylindrical base.

In addition to deck umbrellas, removable mounting of poles to a surface is also desirable in other contexts. For example, removable mounting of poles can facilitate the deployment of selectively positionable fencing, reconfigurable sports goals and nets, as well as pole-mounted cameras and other observational equipment.

One difficulty associated with removable mounting of poles is that in general, making it easier to install a pole at a given location also makes it more likely that the pole may be accidentally displaced, and conversely, the more effectively the pole is secured against accidental displacement, the less convenient it is to install and remove.

For example, Canadian Patent Application No. 2,269,940 (Fretts) teaches a support system for a pole (primarily a utility pole) comprising an anchor including a support member having an internal frusto-conical recess which receives the tapered end of a pole. Holes may be drilled through the support member and lag bolts inserted through the holes and into the pole to secure the pole to the support member. While this effectively secures the pole to the anchor, it makes it cumbersome to install the pole and to remove it if it becomes necessary to do so.

SUMMARY

This document describes pole mounting systems which allow easy engagement and disengagement of a pole base and a support mounting while enabling the pole base, and a pole carried thereby, to be securely retained by the support base when the pole base is interengaged therewith.

A pole mounting system comprises a support mounting and a pole base. The support mounting comprises a body having a receiving aperture opening into a receiving recess in the body. The receiving recess tapers conically inwardly toward a distal end of the receiving recess, relative to the receiving aperture, and at least one helical guide channel is formed in a wall of the receiving recess and extends axially away from the receiving aperture. Each helical guide channel has a channel entrance at the receiving aperture and has a terminal reverse bend at a distal end thereof, relative to the receiving aperture. The pole base comprises an insertion end tapering conically inwardly toward a tip thereof and having at least one guide post extending laterally therefrom. The channel entrance(s) and the guide post(s) have corresponding circumferential positions and the insertion end and the receiving recess are of complementary shape. In use, to releasably secure the pole base to the support mounting, the insertion end of the pole base is inserted through the receiving aperture into the receiving recess with each guide post aligned with the channel entrance of a corresponding one of the at least one helical guide channels, the pole base is then rotated relative to the support mounting in a first rotational direction to drive each guide post along the corresponding helical guide channel to the terminal reverse bend thereof, the insertion end of the pole base is then advanced axially further into the receiving recess to move each guide post into the terminal reverse bend of the corresponding helical guide channel, and the pole base is then rotated axially relative to the support mounting in a second rotational direction opposite the first rotational direction to drive each guide post along the terminal reverse bend of the corresponding helical guide channel until an outer surface of the insertion end engages the wall of the receiving recess.

In a preferred embodiment, when the outer surface of the insertion end engages the wall of the receiving recess, each guide post is spaced from a terminus of the terminal reverse bend of the corresponding helical guide channel.

In a preferred embodiment, there are two diametrically opposed helical guide channels and two diametrically opposed guide posts.

In a preferred embodiment, the channel entrance is generally axially arranged.

In a preferred embodiment, the receiving recess and the insertion end are frusto-conical.

The pole base may form part of a pole, or the pole base may have a receiving end opposite the insertion end, with the receiving end having a receptacle for securely releasably receiving an end of a pole.

In a preferred embodiment, the outer surface of the insertion end is longitudinally crenate.

In a preferred embodiment, the receiving recess and the insertion end each have about a 10 degree longitudinal taper.

BRIEF DESCRIPTION OF THE DRAWINGS

These and other features will become more apparent from the following description in which reference is made to the appended drawings wherein.

DETAILED DESCRIPTION

Figure 1:
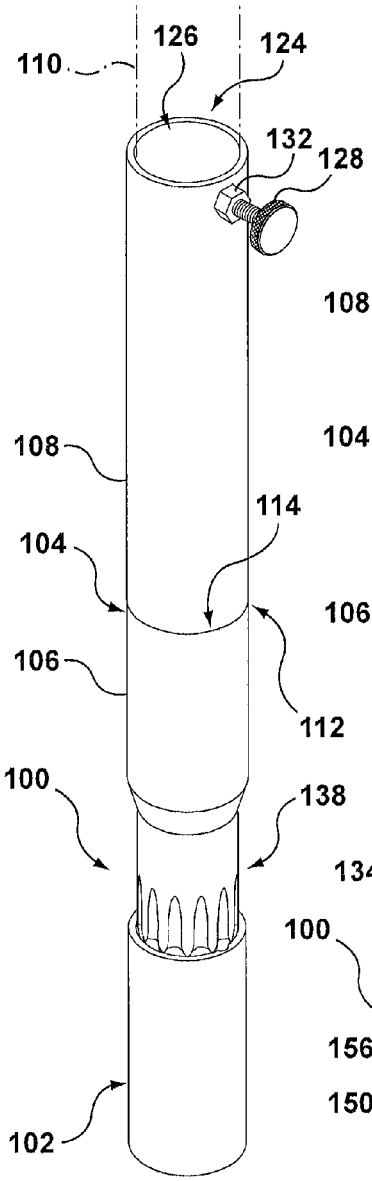
FIG. 1 shows an assembled top perspective view of an exemplary pole mounting system.
Figure 2:
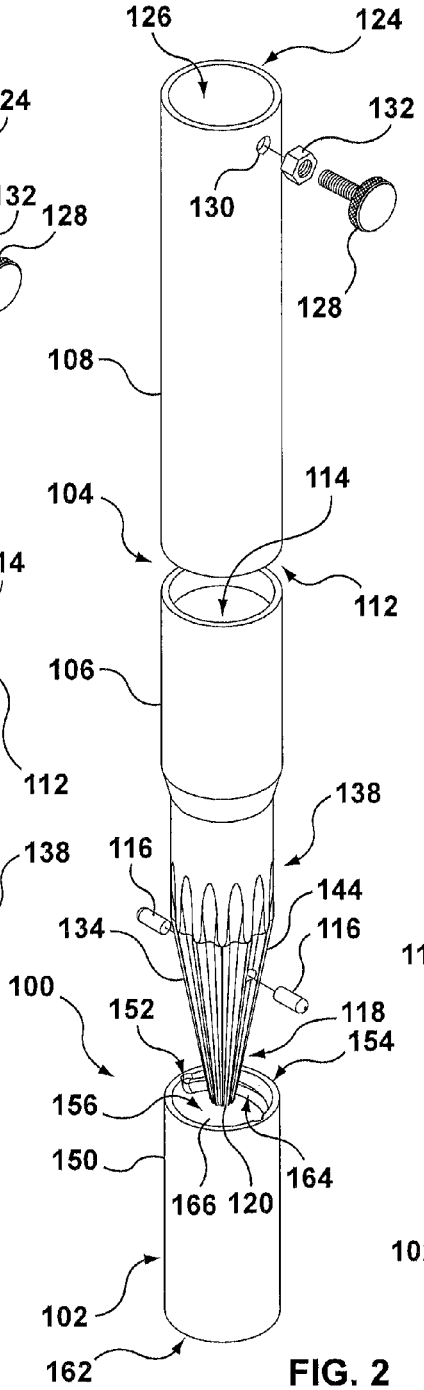
FIG. 2 shows an exploded perspective view of the pole mounting system of FIG. 1.

Reference is now made to FIGS. 1 and 2, which show an exemplary pole mounting system 100. The main components of the exemplary pole mounting system 100 are a support mounting 102 and a first exemplary pole base 104. The support mounting 102 and pole base 104 are preferably formed from a suitable alloy, such as aluminum alloys or stainless steel alloys. FIG. 1 shows an assembled view of the exemplary pole mounting system 100 and FIG. 2 shows an exploded view.

Figure 3:
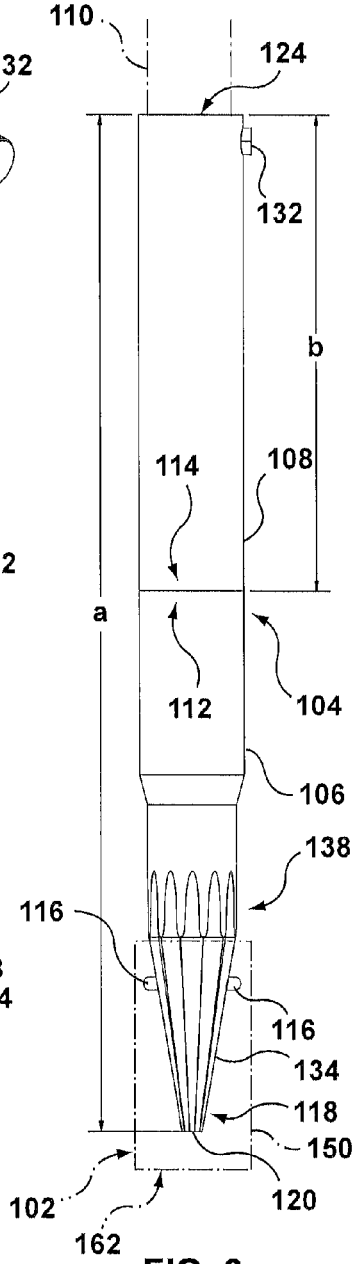
FIG. 3 shows a side elevation view of a first exemplary pole base of the pole mounting system of FIG. 1.
Figures 4A, 4B, 4C, 4D, 4E:
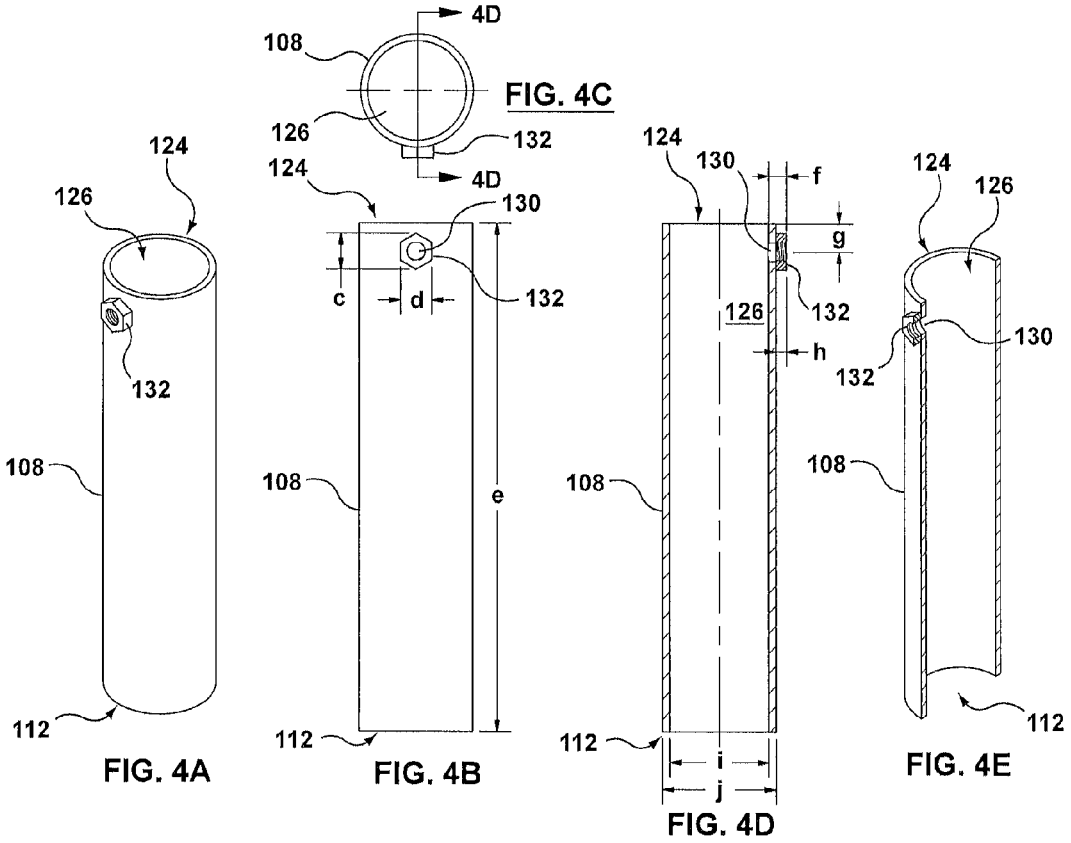
FIG. 4A is a top perspective view of a tubular extension of the pole base of FIG. 3.
FIG. 4B is a front elevation view of the tubular extension of FIG. 4A.
FIG. 4C is a top plan view of the tubular extension of FIG. 4A.
FIG. 4D is a side cross-sectional view of the tubular extension of FIG. 4A, taken along the line 4D-4D in FIG. 4C.
FIG. 4E is a top perspective cross-sectional view of the tubular extension of FIG. 4A.

As can be seen in FIGS. 1, 2 and 3, in the illustrated embodiment the pole base 104 comprises a base portion 106 having an insertion end 118 that interengages with the support mounting 102 and a hollow tubular extension 108 for receiving the end of a pole 110 (FIGS. 1 and 3) such as the shaft of a patio umbrella. In the exemplary embodiment, the base portion 106 and the tubular extension 108 are secured to one another by welding the inferior end 112 of the tubular extension 108 to the superior end 114 of the base portion 106. Other techniques for securing the tubular extension to the base portion may also be used, as described further below.

The base portion 106 includes two diametrically opposed guide posts 116 extending from the inferior end 118 of the base portion 106, which defines an insertion end 118 of the pole base 104. The insertion end 118 tapers conically inwardly toward a tip 120 of the insertion end 118. The end of the tubular extension 108 remote from the base portion 106 is open so as to form a receiving end 124 of the pole base 104 opposite the insertion end 118. The open receiving end 124 has a receptacle 126, namely the interior of the tubular extension 108, for receiving the end of the pole 110, and includes a thumbscrew 128 for securely and releasably retaining the end of the pole 110 in the receptacle 126. In the illustrated embodiment, a thumbscrew aperture 130 is formed in the side wall of the tubular extension 108 adjacent the receiving end 124 and a thumbscrew nut 132 is welded to the outside of the tubular extension 108 in registration with the thumbscrew aperture 130 to threadedly receive the thumbscrew 128. FIGS. 4A through 4E show various views of the tubular extension 108.

Figure 8A:
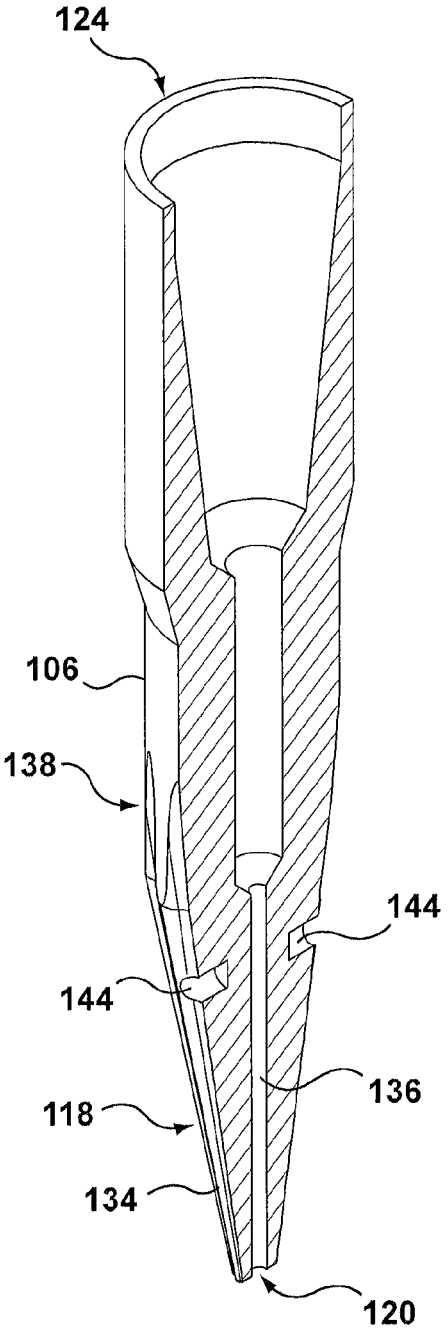
FIG. 8A is a perspective cross-sectional view of the base portion of FIG. 5A.
Figure 8B:
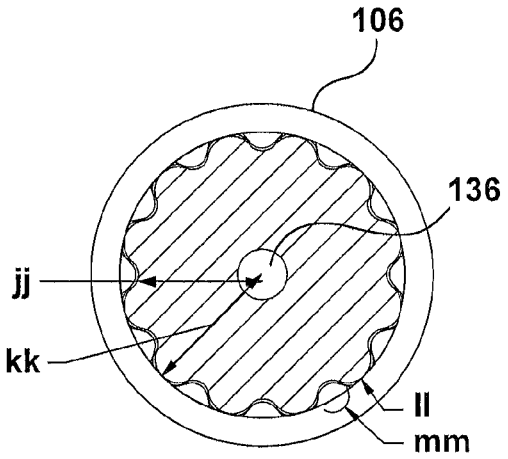
FIG. 8B is a cross-sectional view of the base portion of FIG. 5A, taken along the line 8B-8B in FIG. 5A.
Figure 8C:
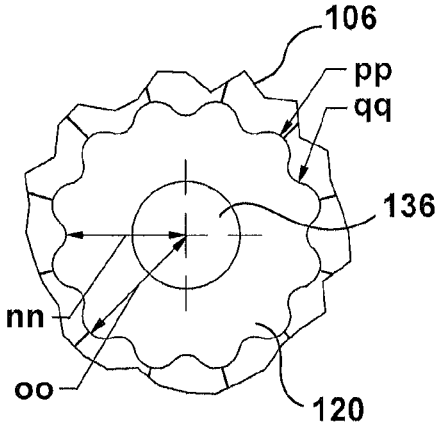
FIG. 8C is a detailed bottom plan view of the base portion of FIG. 5A.
Figure 9A:
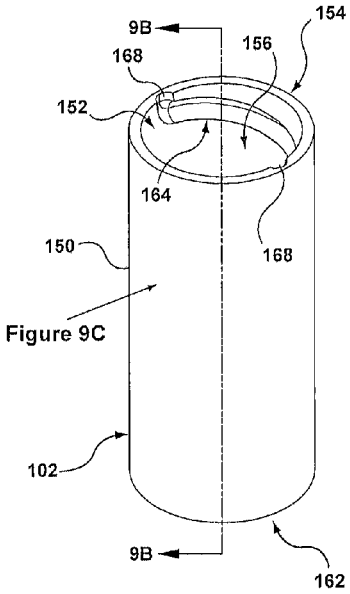
FIG. 9A is a top perspective view of an exemplary support mounting of the pole mounting system of FIG. 1.
Figure 9B:
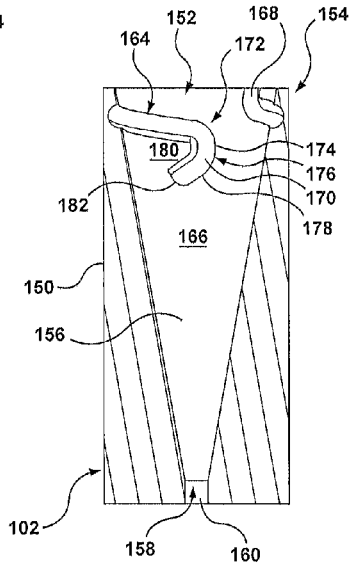
FIG. 9B is a side cross-sectional view of the support mounting of FIG. 9A, taken along the line 9B-9B in FIG. 9A.
Figure 9C:
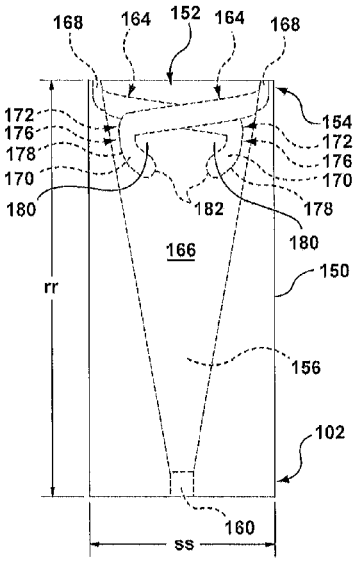
FIG. 9C is a side elevation view of the support mounting of FIG. 9A showing interior features thereof in dashed lines.
Figure 9D:
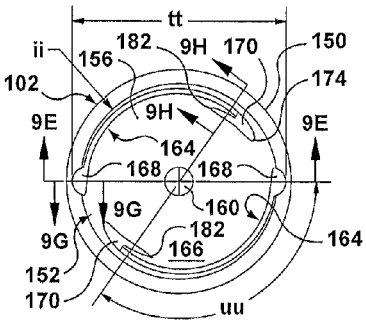
FIG. 9D is a top plan view of the support mounting of FIG. 9A.
Figure 9G:
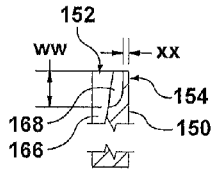
FIG. 9G is a cross-sectional view of a portion of the support mounting of FIG. 9A, taken along the line 9G-9G in FIG. 9D, showing the channel entrance to the helical guide channel of FIG. 9F.
Figure 9H:
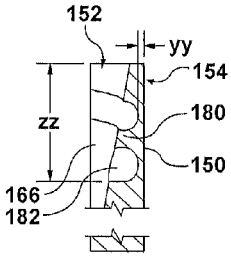
FIG. 9H is a cross-sectional view of a portion of the support mounting of FIG. 9A, taken along the line 9H-9H in FIG. 9D, showing the terminal reverse bend of the helical guide channel of FIG. 9F.
Figure 9E:
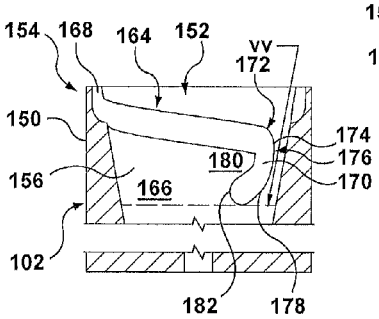
FIG. 9E is a side cross-sectional view of the support mounting of FIG. 9A, taken along the line 9E to 9E in FIG. 9D.
Figure 9F:
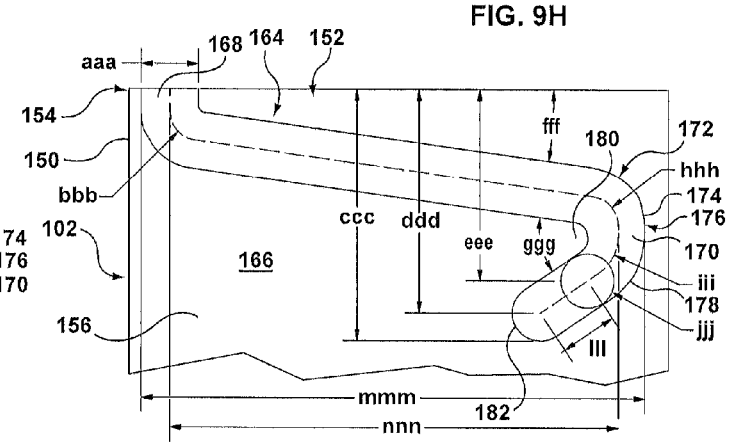
FIG. 9F is a detailed unrolled view of a portion of the wall of the receiving recess of the support mounting of FIG. 9A, showing the helical guide channel formed therein.

FIGS. 5A to 6C and 8A to 8C show various views of the base portion 106 of the pole base 104. As can be seen, the outer surface 134 of the insertion end 118 is longitudinally crenate, and in particular is scalloped; the scalloping extends beyond the conically tapering insertion end 118 onto a cylindrical intermediate portion 138 of the base portion 106. Details of exemplary scalloping are shown in FIGS. 8B to 8C.

Figure 5C:
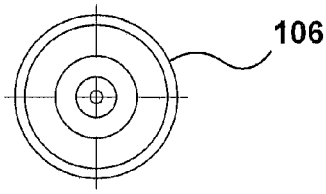
FIG. 5C is a top plan view of the base portion of FIG. 5A.
Figure 5A:
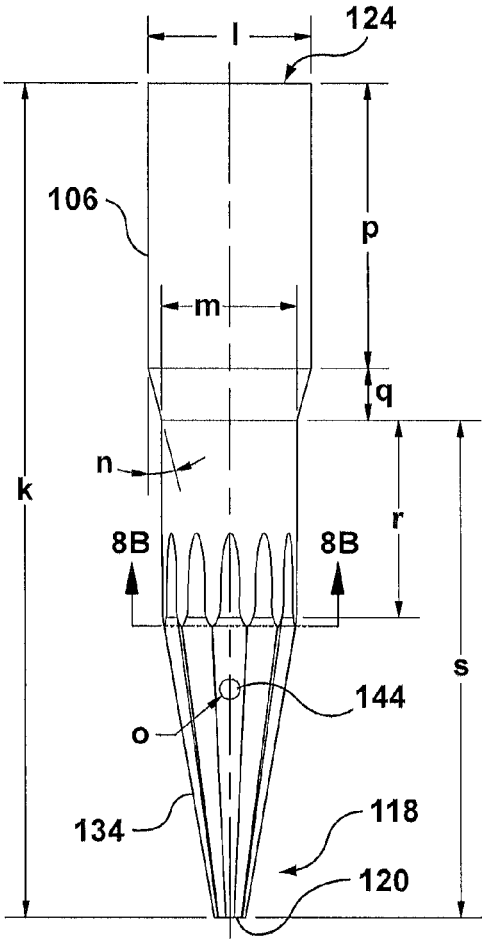
FIG. 5A is a side elevation view of a base portion of the pole base of FIG. 3, without its guide posts.
Figure 5D:
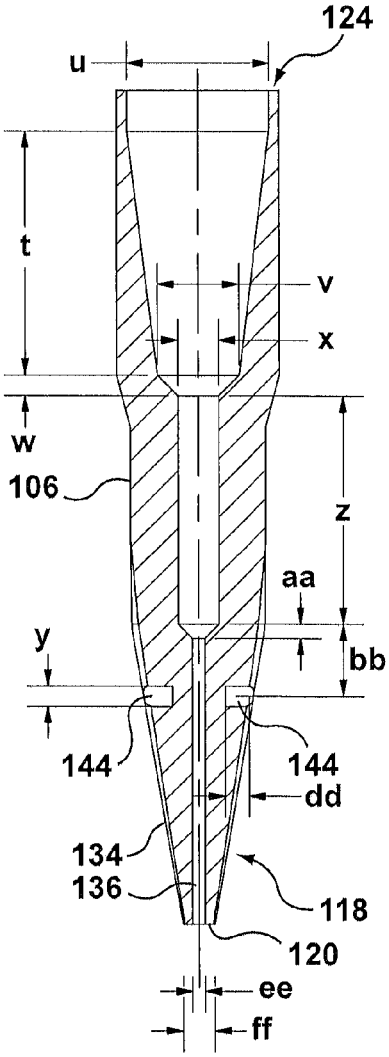
FIG. 5D is a side cross-sectional view of the base portion of FIG. 5A, taken along the line 5D-5D in FIG. 5B.
Figure 5B:
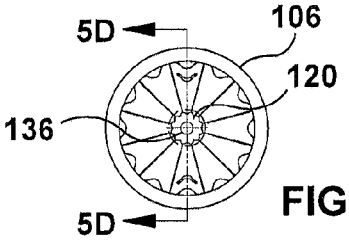
FIG. 5B is a bottom plan view of the base portion of FIG. 5A.
Figure 6A:
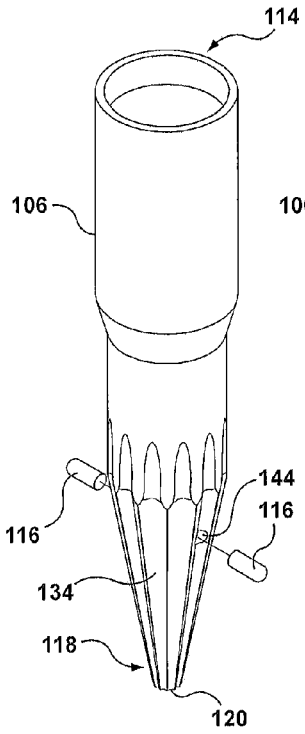
FIG. 6A is an exploded top perspective view of the base portion of FIG. 5A, with the guide posts.
Figure 6B:
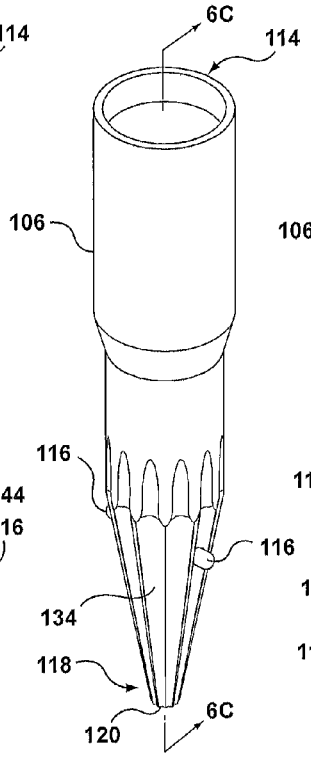
FIG. 6B is an assembled top perspective view of the base portion of FIG. 6A.
Figure 6C:
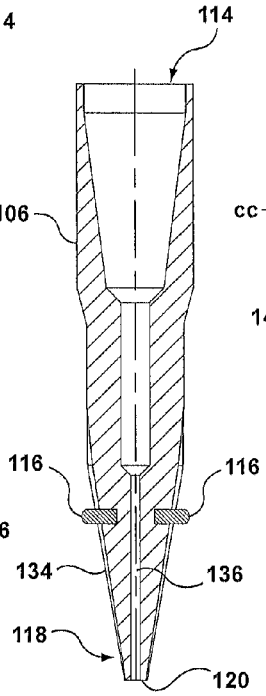
FIG. 6C is a side cross-sectional view of the base portion of FIG. 6A, taken along the line 6C-6C in FIG. 6B.

As best seen in FIGS. 5D and 6C, a drainage passage 136 extends through the base portion 106 from the superior end 114 of the base portion 106 to the insertion end 118 thereof. The drainage passage 136 narrows progressively from the superior end 114 of the base portion 106 to the insertion end 118 thereof.

Figure 7A:
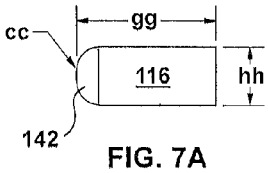
FIG. 7A is a side elevation view of a guide post of the base portion of FIG. 6A.
Figure 7B:
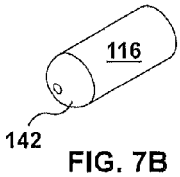
FIG. 7B is a perspective view of the guide post of FIG. 7A.

As noted above, two diametrically opposed guide posts 116 extend laterally from the conically tapering insertion end 118; in the illustrated embodiment each of the guide posts 116 has a rounded end 142 as shown in FIGS. 7A and 7B and is press-fit into one of a pair of diametrically opposed holes 144 (FIGS. 6A and 8A) formed in the conically tapering insertion end 118. Other techniques for securing the guide posts 116 to the insertion end 118 may also be used.

The pole base 104, in particular the insertion end 118 thereof, is interengageable with the support mounting 102, an exemplary embodiment of which will now be described in greater detail.

Referring now to FIGS. 9A to 9F, the exemplary support mounting 102 comprises a generally cylindrical body 150 having a receiving aperture 152 at a superior end 154 thereof. Although the body of the support mounting is advantageously outwardly cylindrical, it may have other suitable outward shapes as well. The receiving aperture 152 opens into a receiving recess 156 in the body 150. The receiving recess 156 tapers conically inwardly toward a distal end 158 of the receiving recess 154, relative to the receiving aperture 152, so that the receiving recess 154 is widest at the receiving aperture 152 and narrowest at the distal end 154; that is, the end of the receiving recess 156 that is remote from the receiving aperture 152. Importantly, the conically tapering shape of the receiving recess 156 is complementary to the conically tapering shape of the insertion end 118 of the pole base 104 to facilitate interengagement of the pole base 104 with the support mounting 102, as described in greater detail below. In the illustrated embodiment, the receiving recess 156 and the insertion end 118 are both frusto-conical and both have about a 10 degree longitudinal taper.

A drainage passage 160 is formed in the inferior end 162 of the body 150 and communicates with the distal end 158 of the receiving recess 154; the drainage passage 160 in the body 150 cooperates with the drainage passage 136 through the base portion 106 to facilitate drainage of fluids (e.g. rainwater) entering the open receiving end 124 of the tubular extension 108.

Two diametrically opposed helical guide channels 164 are formed in the wall 166 of the receiving recess 156; these helical guide channels 164 cooperate with the guide posts 116 as described further below. Each helical guide channel 164 has a generally axially arranged channel entrance 168 at the proximal end thereof, relative to the receiving aperture 152, and extends axially away from the receiving aperture 152. Thus, each channel entrance 168 is open at the receiving aperture 152 and the helical guide channels 164 wind helically around the wall 166 of the receiving recess 156 from the receiving aperture 152 toward the distal end 158 of the receiving recess 154. Since both the guide posts 116 and the helical guide channels 164 are diametrically opposed, the channel entrances 168 and the guide posts 116 have corresponding circumferential positions to enable the guide posts 116 to be inserted into the helical guide channels 164 by way of the channel entrances 168. Each helical guide channel 164 has a terminal reverse bend 170 at the distal end 172 thereof, relative to the receiving aperture 152.

Figure 10A:
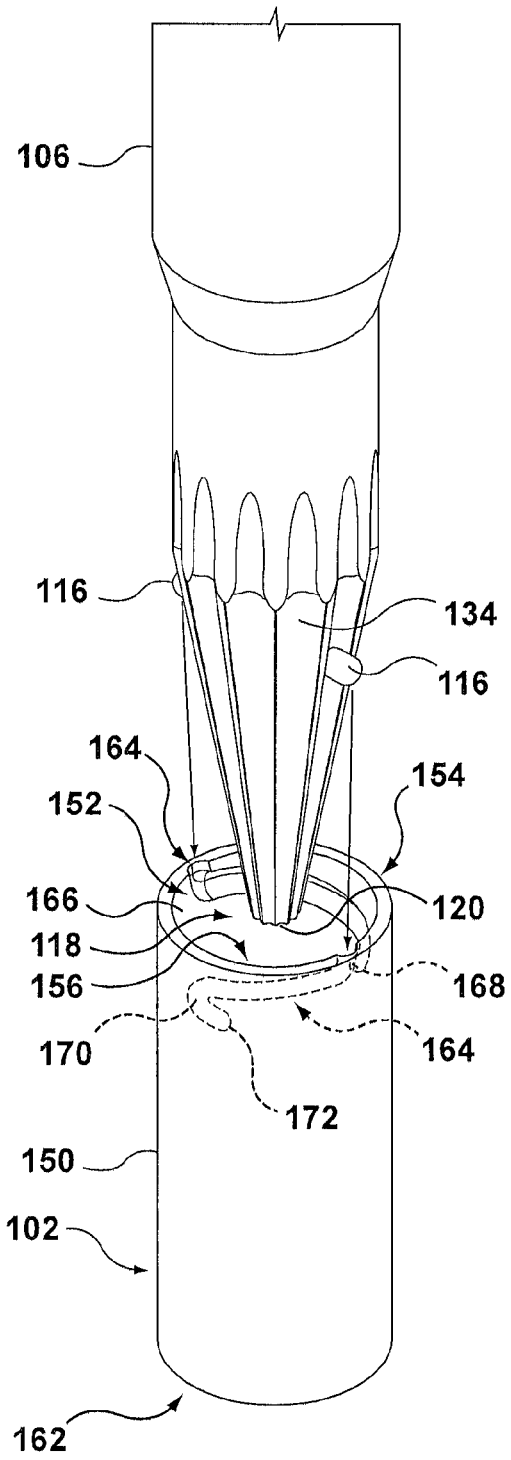
FIGS. 10A and 10B show interengagement of the pole base of FIG. 3 with the support mounting of FIG. 9A.
Figure 10B:
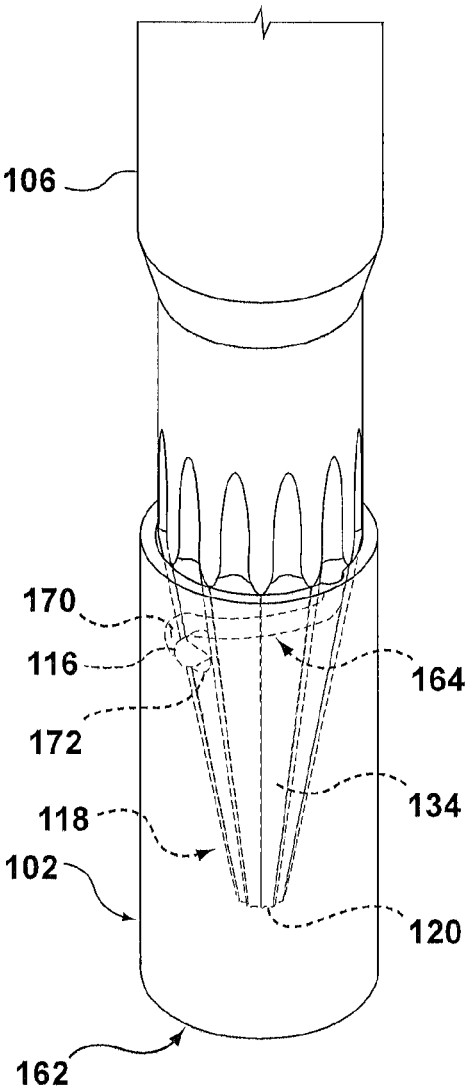

Turning now to FIGS. 10A to 11B, interengagement of the pole base 104 and the support mounting 102 will now be described. To releasably secure the pole base 104 to the support mounting 102, the insertion end 118 of the pole base 104 is inserted through the receiving aperture 152 into the receiving recess 156, as shown in FIG. 10A. FIG. 11A shows one of the guide posts 116 at various positions within its respective helical guide channel 164. As can be seen in FIG. 10A, when the insertion end 118 of the pole base 104 is inserted into the receiving recess 156, each guide post 116 is aligned with the channel entrance 168 of a corresponding helical guide channel 164. Position "A" in FIG. 11A shows the guide post 116 in the channel entrance 168 of the corresponding helical guide channel 164. The pole base 104 is then rotated axially relative to the support mounting; that is, rotated about the common axis of the helical guide channels 164. Rotation of the pole base 104 in this first rotational direction drives each guide post 116 along the corresponding helical guide channel 164 to the terminal reverse bend 170 thereof. Position "B" in FIG. 11A shows the guide post 116 moving along the corresponding helical guide channel 164. Once the guide posts 116 reach the respective terminal reverse bends 170, further rotation of the pole base 104 in the first rotational direction is inhibited because the guide posts 116 engage the outer edges 174 of the respective helical guide channels 164 at the elbows 176 of the reverse bends 170. Position "C" in FIG. 11A shows the guide post 116 having reached the terminal reverse bend 170 of the respective helical guide channel 164. The insertion end 118 of the pole base 104 is then advanced axially further into the receiving recess 156, which moves each guide post 116 into the terminal reverse bend 170 of the respective helical guide channel 164, at which point further direct axial movement of the insertion end 118 into the receiving recess 156 is obstructed by engagement of the guide posts with the lower edges 178 of the respective helical guide channels 164 at the elbows 176 of the reverse bends 170. The pole base 104 is then rotated axially relative to the support mounting 102 in a second rotational direction opposite the first rotational direction to drive each guide post 116 along the terminal reverse bend 170 of the corresponding helical guide channel 164 until the outer surface 134 of the insertion end 118 engages the wall 166 of the receiving recess 156. This final rotation is typically slight, and may occur by gravity as the weight of the pole base 104 causes the guide posts to slide downwardly along the reverse bends 170.

With the pole base 104 secured to the support mounting 102 as shown, that is, with the outer surface 134 of the insertion end 118 engaging the wall 166 of the receiving recess 156 and the guide posts 116 within the respective terminal reverse bends 170, the pole base 104 will be resistant to unintentional removal from the support mounting 102. Removal of the pole base 104 from the support mounting 102 requires rotation of the pole base 104 in the first rotational direction to drive the guide posts 116 into the elbows 176 of the reverse bends 170, followed by axial movement of the pole base 104 outwardly relative to the receiving recess 156, followed by rotation of the pole base 104 in the second rotational direction to drive each guide post 116 along the corresponding helical guide channel 164 to the channel entrance 168 thereof. As such, where the pole base 104 is used to support, for example, a patio umbrella, the likelihood that wind forces could separate the pole base 104 from the support mounting 102 is reduced, since separation requires rotation of the pole base 104 relative to the support mounting 102 in two opposite directions. If wind force were to rotate the pole base 104 in the first rotational direction, after the guide posts 116 move into the elbows 176 of the reverse bends 170, further rotation of the pole base 104 in the first rotational direction is inhibited because the guide posts 116 engage the outer edges 174 of the respective helical guide channels 164 at the elbows 176, so the pole base 104 remains secured to the support mounting 102. Conversely, rotation of the pole base 104 in the second rotational direction, as well as axial movement of the pole base 104 away from the support mounting 102, is resisted by engagement of the guide posts 116 with the shoulders 180 formed by the elbows 176 of the reverse bends 170, so that the pole base 104 remains secured to the support mounting 102.

Figure 11A:
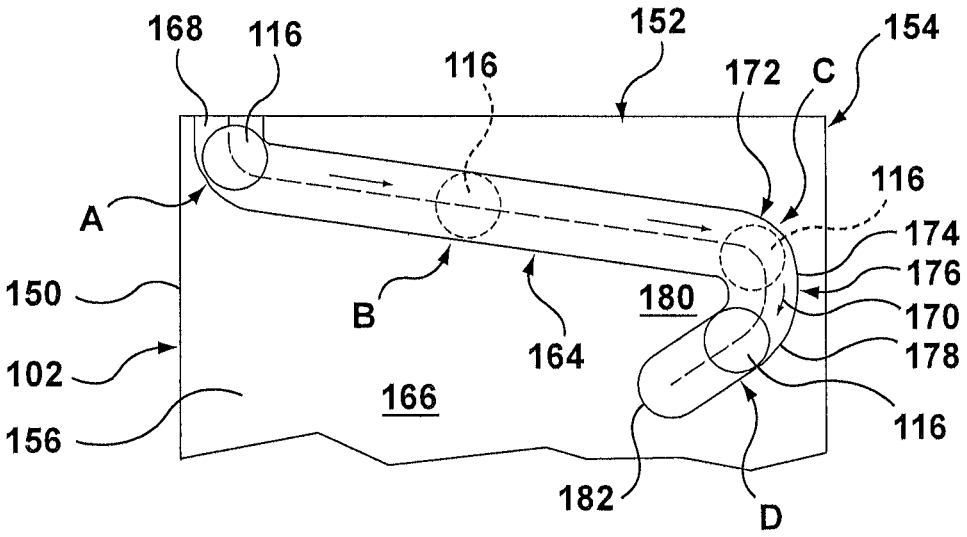
FIG. 11A shows one of the guide posts at various positions within its respective helical guide channel during interengagement of the pole base of FIG. 3 with the support mounting of FIG. 9A.
Figure 11B:
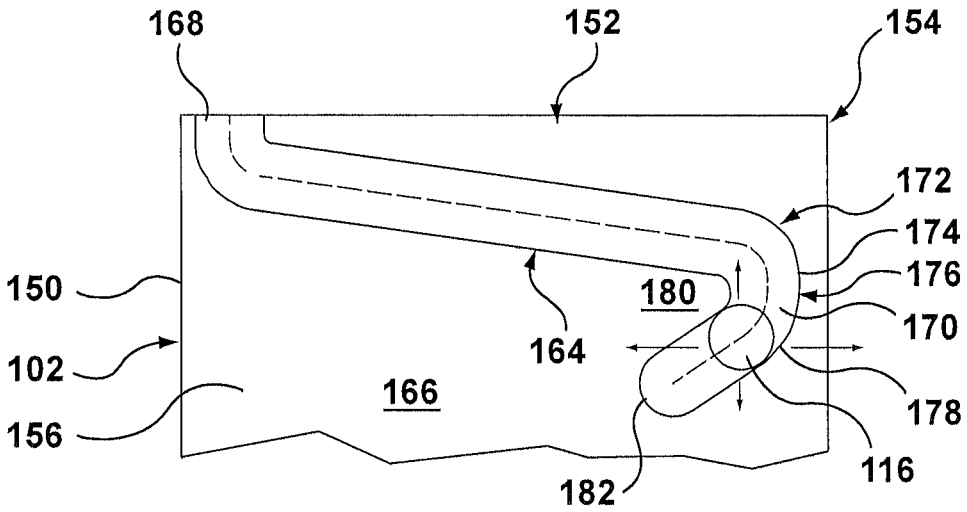
FIG. 11B shows the position of the guide posts within the reverse bends of the respective helical guide channels when the outer surface of the insertion end of the pole base of FIG. 3 engages the wall of the receiving recess of the support mounting of FIG. 9A.
Figure 12A:
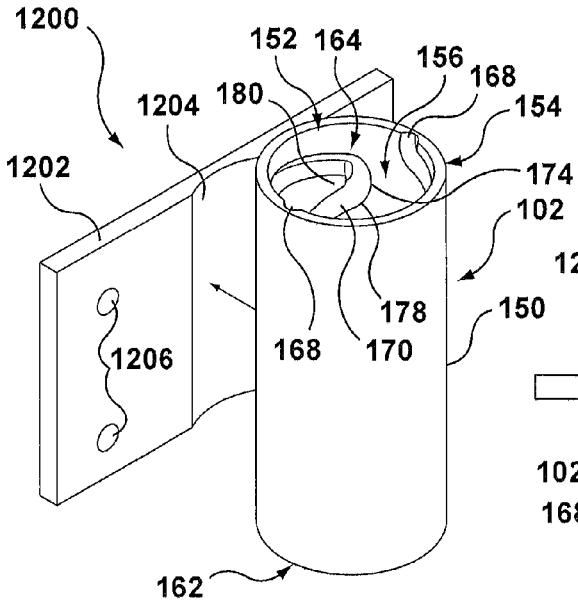
FIG. 12A is an exploded top perspective view of a first exemplary receiver formed by welding the support mounting of FIG. 9A to a generally planar bracket.
Figure 12D:
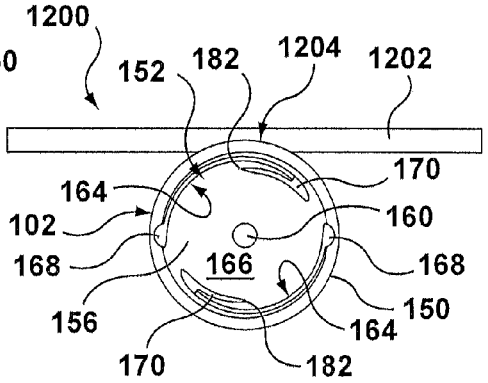
FIG. 12D is a top plan view of the receiver of FIG. 12A.
Figure 12B:
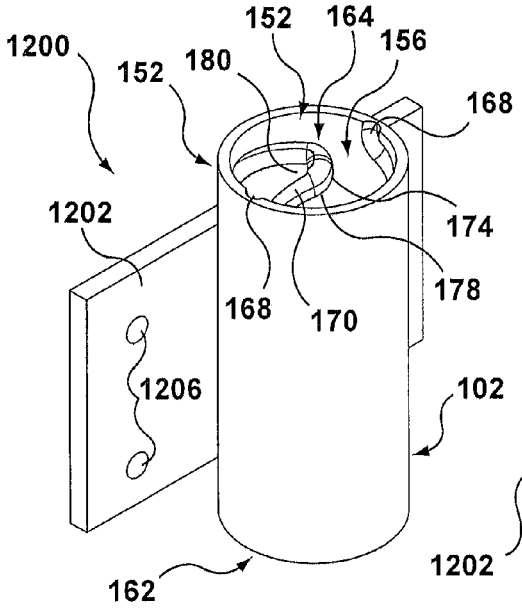
FIG. 12B is a top perspective view of the receiver of FIG. 12A.
Figure 12C:
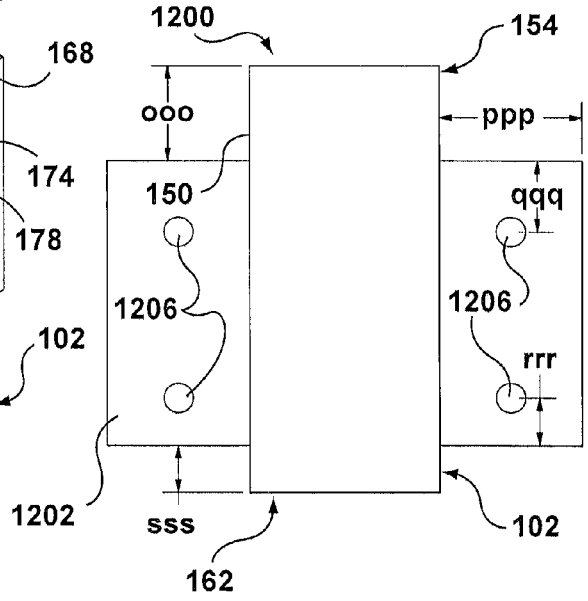
FIG. 12C is a front elevation view of the receiver of FIG. 12A.
Figure 13A:
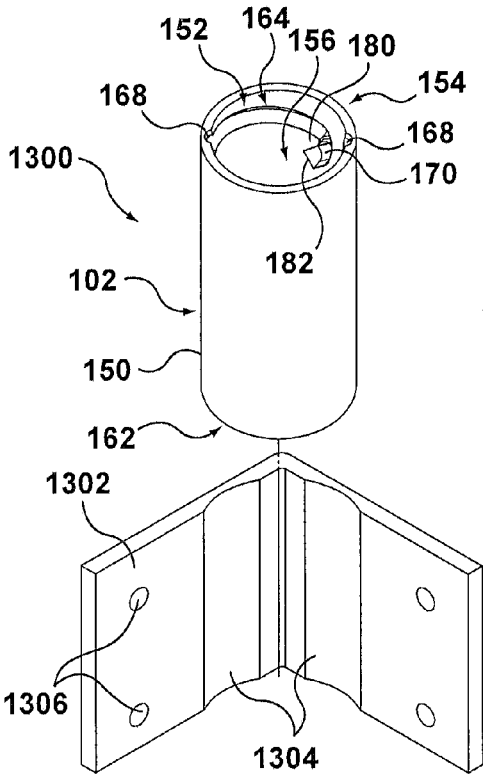
FIG. 13A is an exploded top perspective view of a second exemplary receiver formed by welding the support mounting of FIG. 9A to a generally L-shaped corner bracket.
Figure 13D:
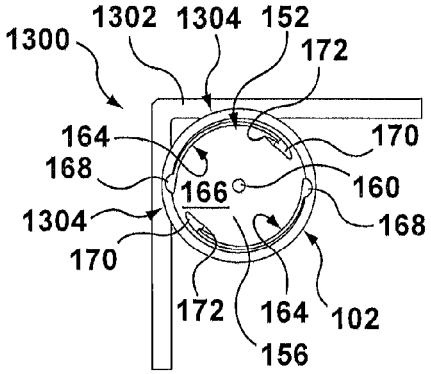
FIG. 13D is a top plan view of the receiver of FIG. 13A.
Figure 13C:
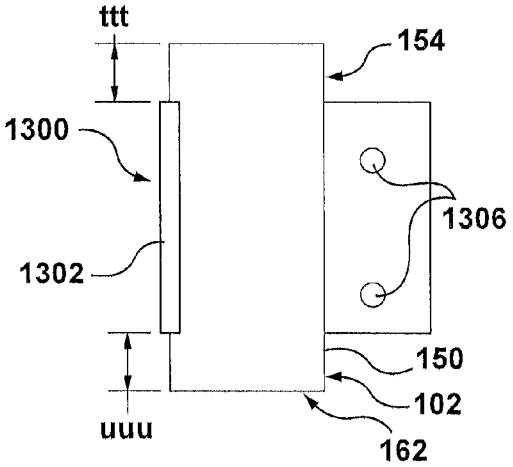
FIG. 13C is a side elevation view of the receiver of FIG. 13A.
Figure 13B:
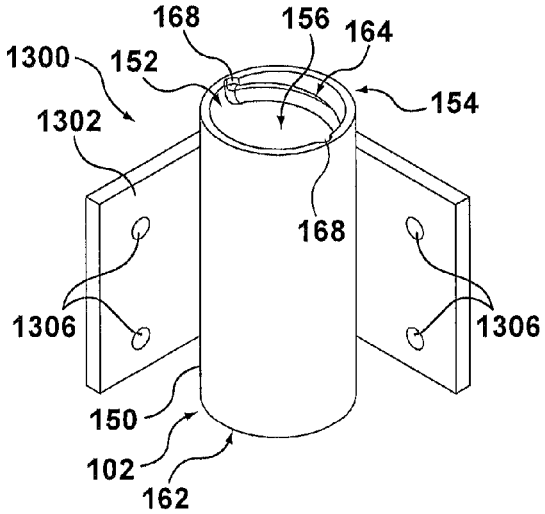
FIG. 13B is a top perspective view of the receiver of FIG. 13A.
Figure 13E:
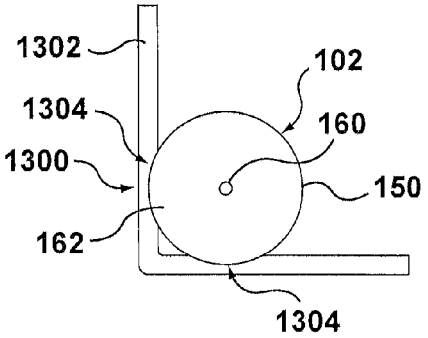
FIG. 13E is a bottom plan view of the receiver of FIG. 13A.
Figure 14D:
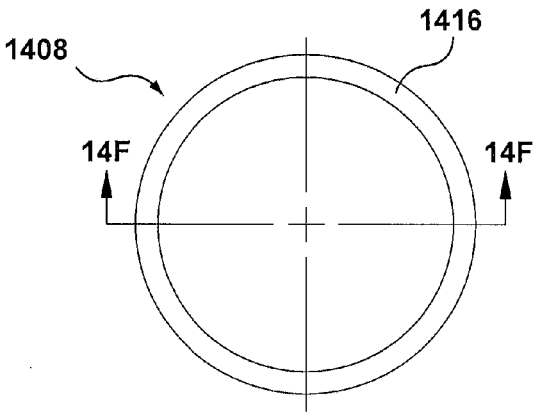
FIG. 14D is a top plan view of the collar of FIG. 14A.
Figure 14B:
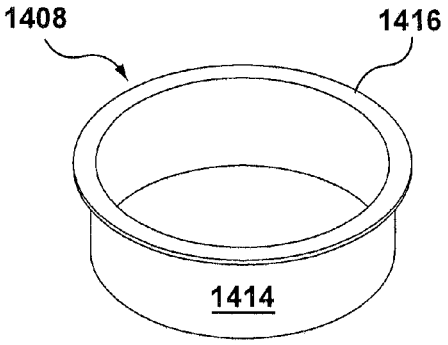
FIG. 14B is a top perspective view of the collar of FIG. 14A.
Figure 14C:
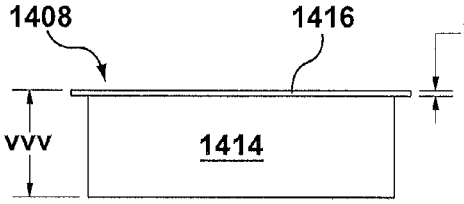
FIG. 14C is a side elevation view of the collar of FIG. 14A.
Figure 14F:
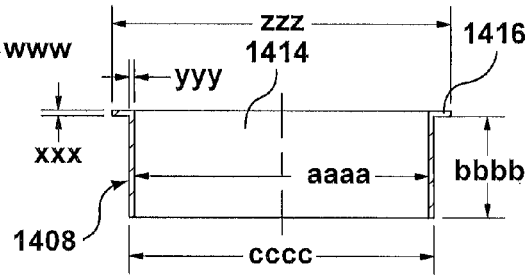
FIG. 14F is a side cross-sectional view of the collar of FIG. 14A, taken along the line 14F-14F in FIG. 14D.
Figure 14E:
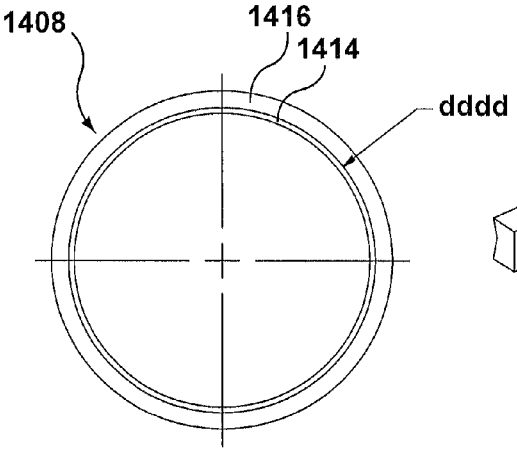
FIG. 14E is a bottom plan view of the collar of FIG. 14A.
Figure 14A:
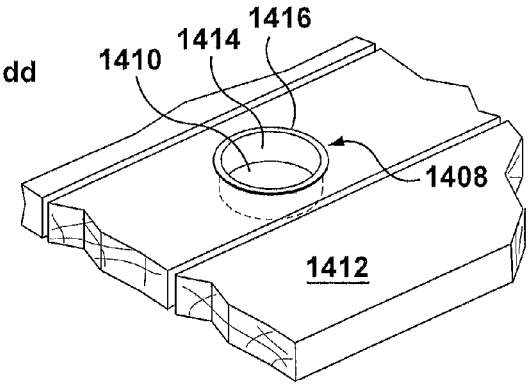
FIG. 14A is a top perspective view showing an exemplary collar secured within an umbrella aperture in a deck.

Reference is now made specifically to FIG. 11B, which shows by representative example the position of the guide posts 116 within the respective helical guide channels 164, specifically the reverse bends 170 thereof, when the outer surface 134 of the insertion end 118 engages the wall 166 of the receiving recess 156. As can be seen, in a preferred embodiment, when the outer surface 134 of the insertion end 118 engages the wall 166 of the receiving recess 156, each guide post 116 is spaced from the terminus 182 of the reverse bend 170 of the corresponding helical guide channel 164. In a particularly preferred embodiment, each guide post 116 is spaced from the terminus 182 of the reverse bend 170 of the corresponding helical guide channel 164 by a distance of about ¼ inch. It is expected that over time, engagement of the outer surface 134 of the insertion end 118 with the wall 166 of the receiving recess 156 will lead to wear on one or both parts. The spacing of the guide posts 116 from the terminus 182 of the reverse bend 170 accommodates this anticipated wear, preventing a situation in which the guide posts 116 reach the terminus 182 of the reverse bend 170 before the outer surface 134 of the insertion end 118 engages the wall 166 of the receiving recess 156, which would result in instability.

Support mountings 102 may be secured in any location where it is desired to releasably secure a pole. For example, a plurality of support mountings 102 may be suitably distributed about a deck, swimming pool or patio to releasably receive one or more umbrellas. FIGS. 12A to 12D show a first exemplary receiver 1200 formed by a support mounting 102 welded to an exemplary generally planar bracket 1202 which includes a curved trough 1204 to accommodate the support mounting 102 and four through-holes 1206 for receiving fasteners. Similarly, FIGS. 13A to 13E show a second exemplary receiver 1300 formed by a support mounting 102 welded to an exemplary generally L-shaped corner bracket 1302 which includes two opposed curved troughs 1304 to accommodate the support mounting 102 and four through-holes 1306 for receiving fasteners. The brackets 1202, 1302 shown in FIGS. 12A to 12D and 13A to 13E, respectively, may be used to position the support mounting 102 beneath and in registration with umbrella apertures in a deck. In other embodiments, receivers may be cast as a single monolithic element, and more or fewer through-holes may be provided.

Figure 15:
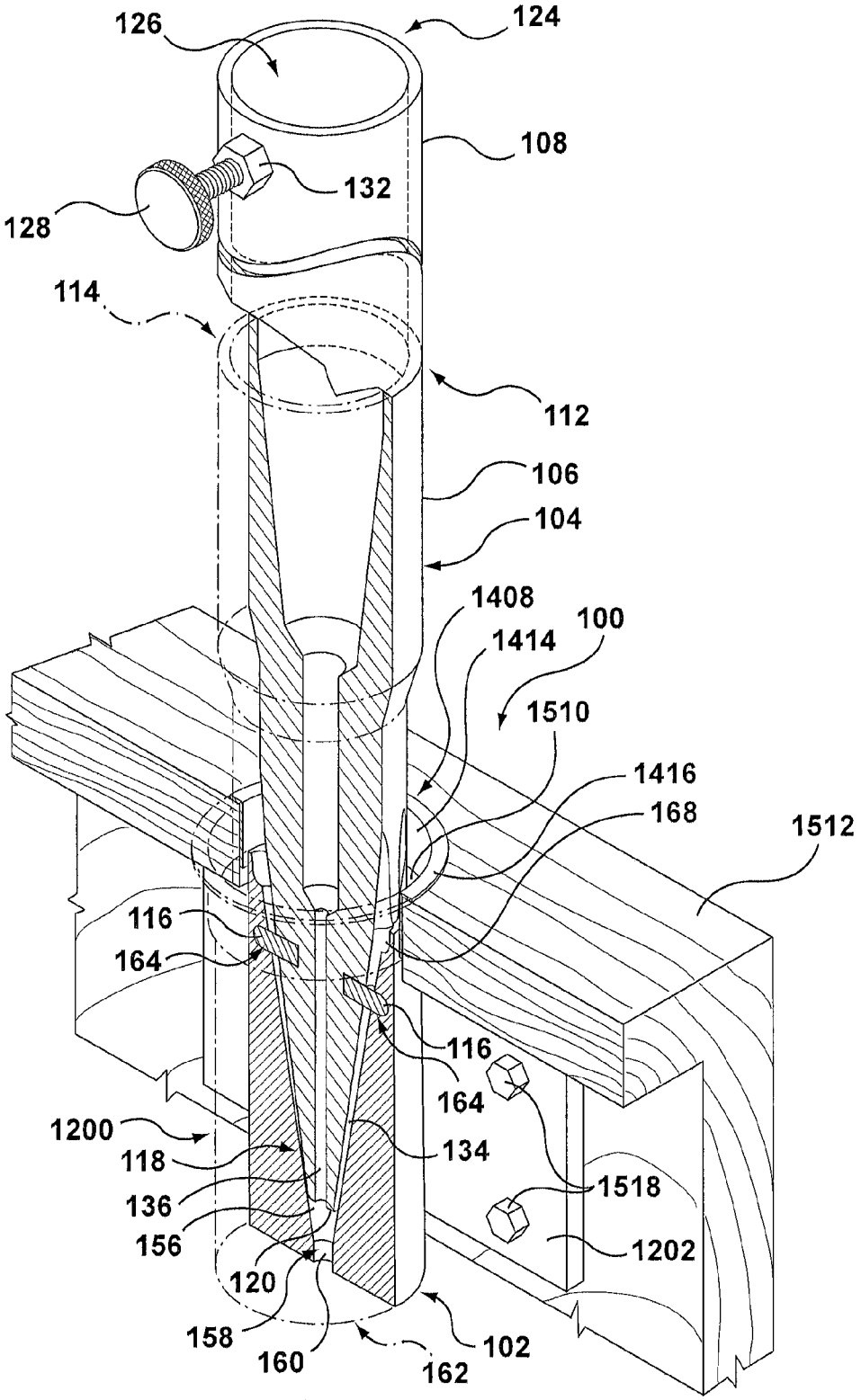
FIG. 15 is a perspective cut-away cross-sectional view showing the receiver of FIG. 13A secured beneath an umbrella aperture in a deck.
Figure 16:
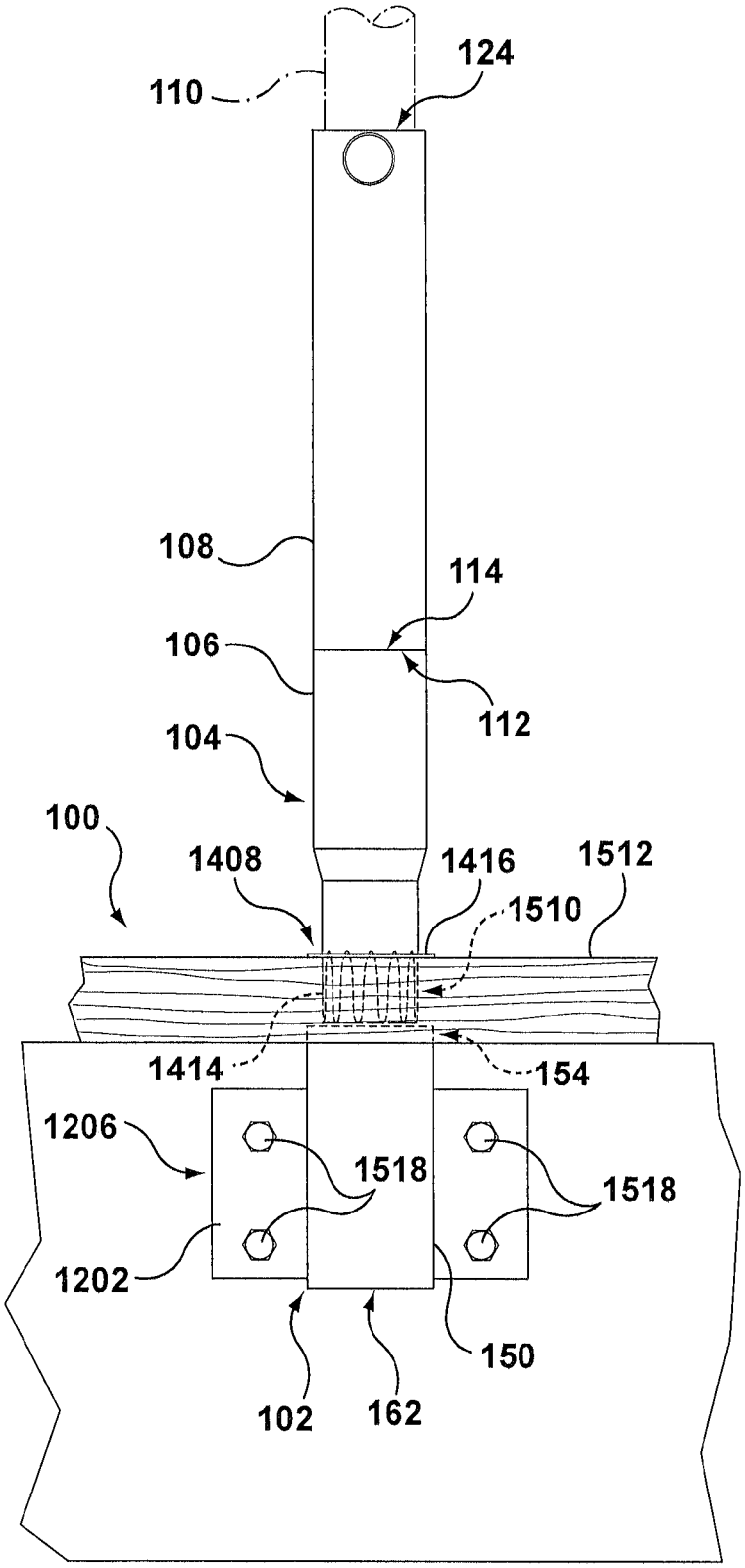
FIG. 16 is a side view showing the receiver of FIG. 13A secured beneath an umbrella aperture in a deck.

FIGS. 14A to 14F show an exemplary collar 1408 which may be secured within such an umbrella aperture 1410 in a deck 1412. The collar 1408 comprises a cylindrical tubular body 1414 that is open at both ends, with an outwardly projecting annular flange 1416 at one end thereof. FIGS. 15 and 16 show a receiver 1200 secured beneath an umbrella aperture 1510 in a deck 1512 by way of wood bolts 1518 passing through the through-holes 1206 in the planar bracket 1202, with a collar 1408 secured in the umbrella aperture 1510 and a pole base 104 releasably received by the support mounting 102. Optionally, a removable cap (not shown) may be fitted within the collar 1408 to close the umbrella aperture 1510 when the support mounting 102 underneath is not in use.

Figure 17:
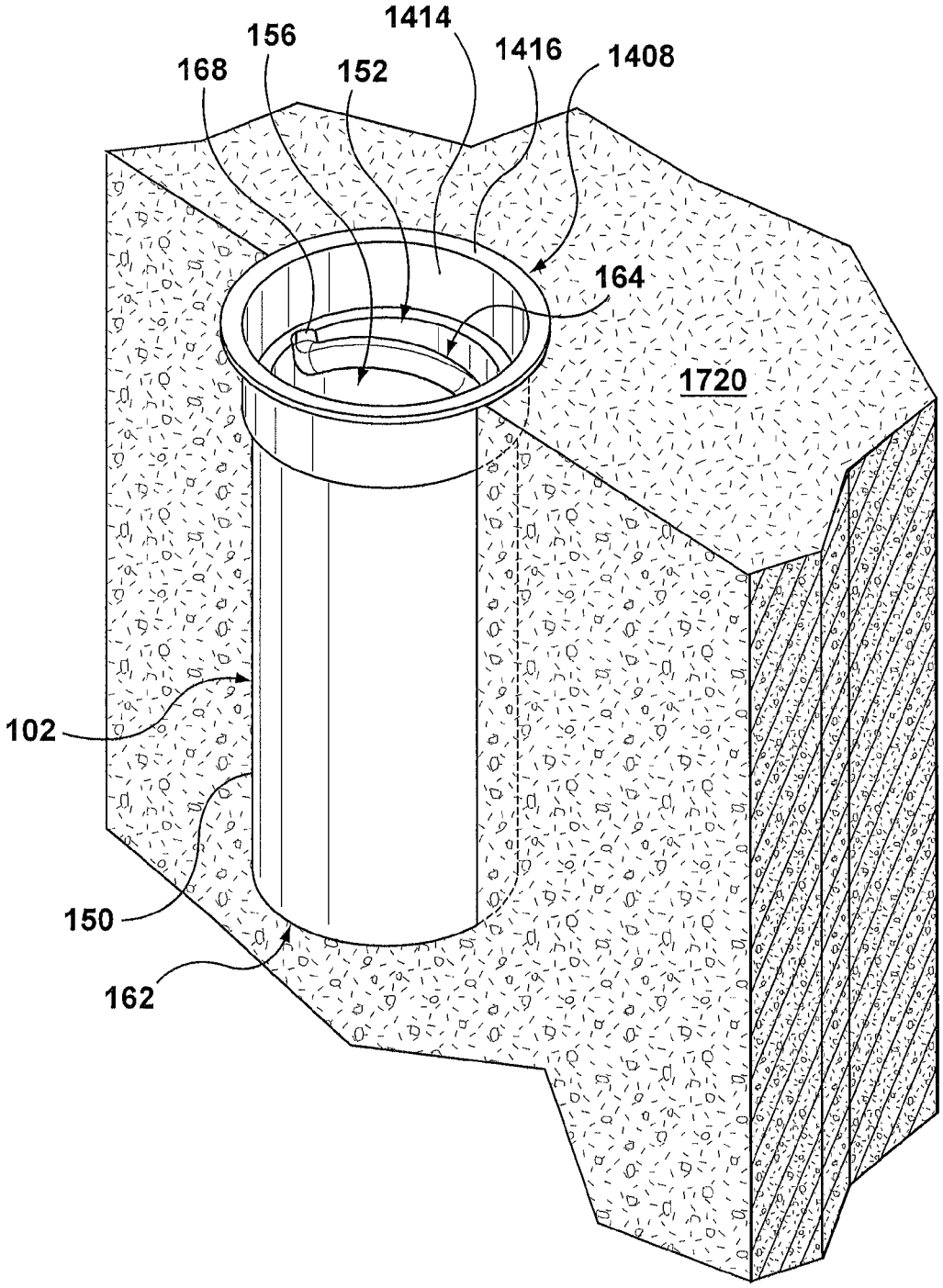
FIG. 17 is a top perspective cut-away view showing the support mounting of FIG. 9A and the collar of FIG. 14A embedded in concrete.

Support mountings 102 and collars 1408 may also, for example, be embedded in concrete 1720 as shown in FIG. 17. The support mountings 102 and collars 1408 may be embedded at the time that the concrete is poured as shown in FIG. 17, or may be inserted into a hole bored in the concrete and secured using a suitable bonding agent, with spring clips or other apparatus used to space the support mounting from the wall of the hole to enable bonding agent to be poured into the hole and set.

Figure 18A:
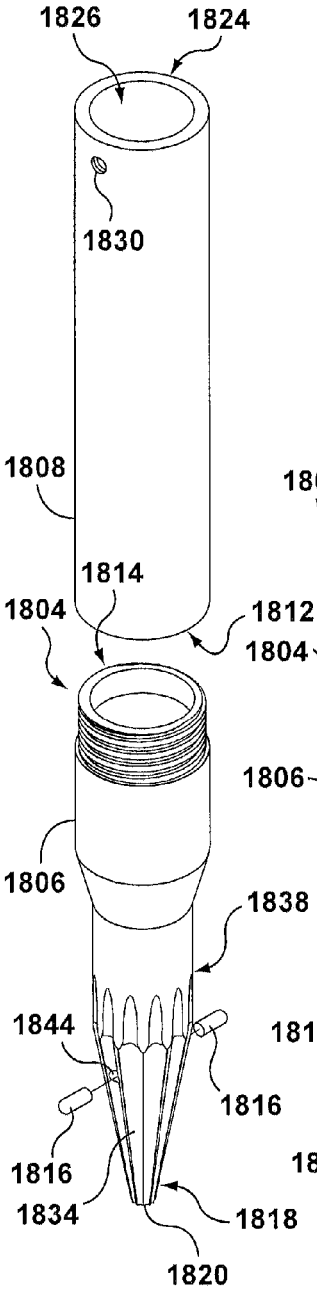
FIG. 18A is an exploded top perspective view of a second exemplary pole base.
Figure 18B:
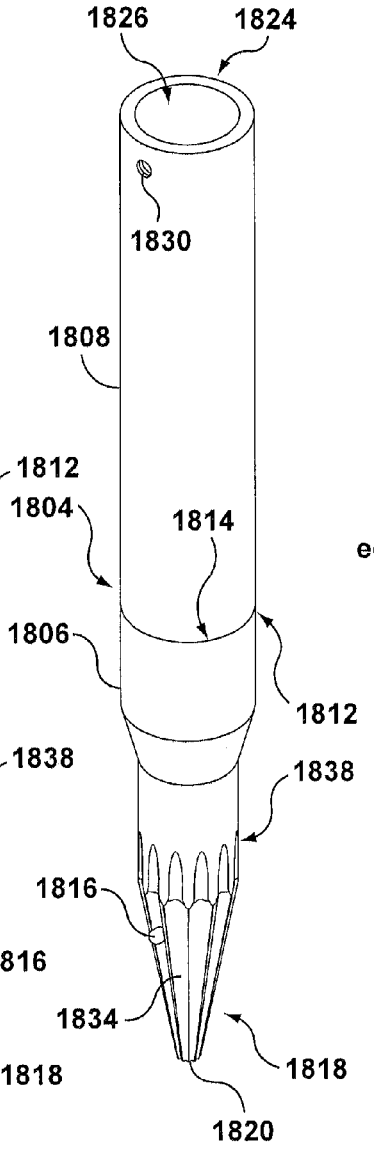
FIG. 18B is an assembled top perspective view of the pole base of FIG. 18A.
Figure 19:
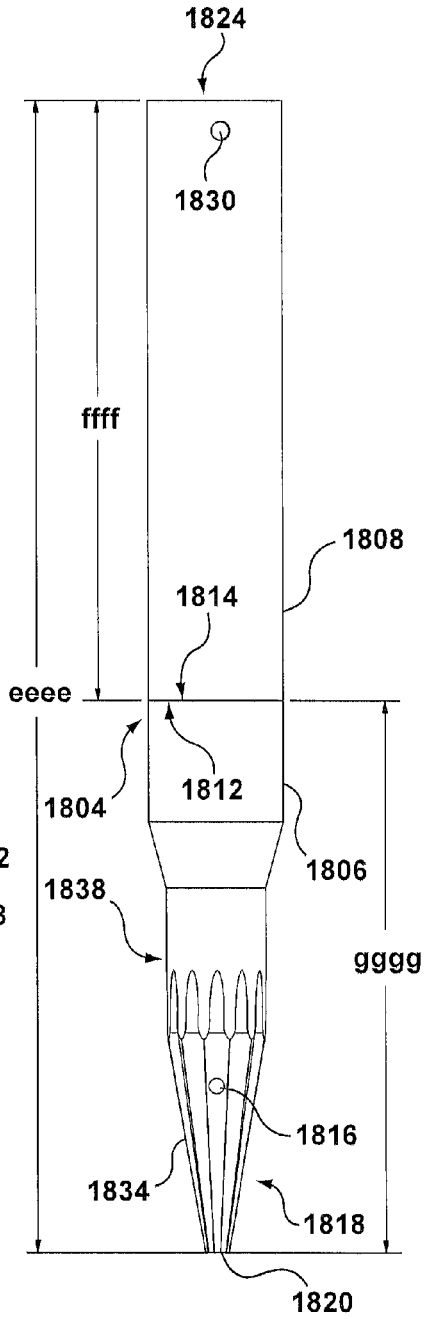
FIG. 19 is a side elevation view of the pole base of FIG. 18A.
Figure 20C:
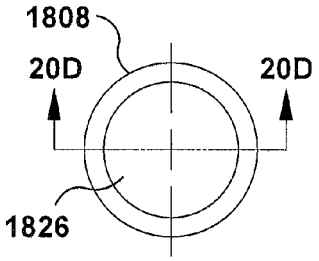
FIG. 20C is a top plan view of the tubular extension of FIG. 20A.
Figures 20A, 20B, 20D, 20E:
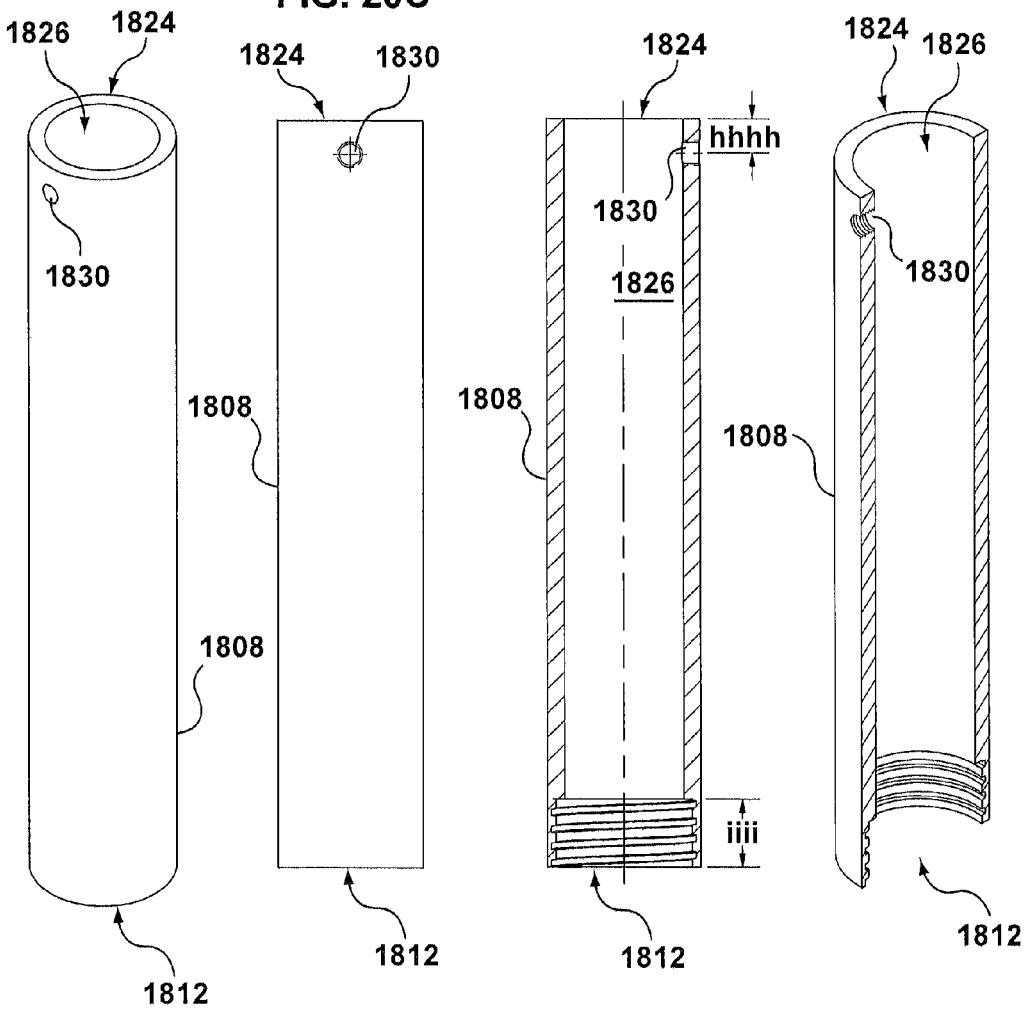
FIG. 20A is a top perspective view of a tubular extension of the pole base of FIG. 18A.
FIG. 20B is a front elevation view of the tubular extension of FIG. 20A.
FIG. 20D is a side cross-sectional view of the tubular extension of FIG. 20A, taken along the line 20D-20D in FIG. 20C.
FIG. 20E is a top perspective cross-sectional view of the tubular extension of FIG. 20A.
Figure 21B:
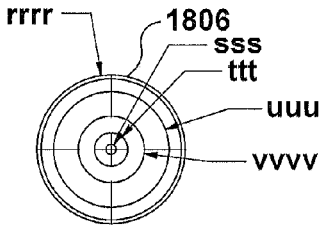
FIG. 21B is a top plan view of the base portion of FIG. 21A.
Figure 21A:
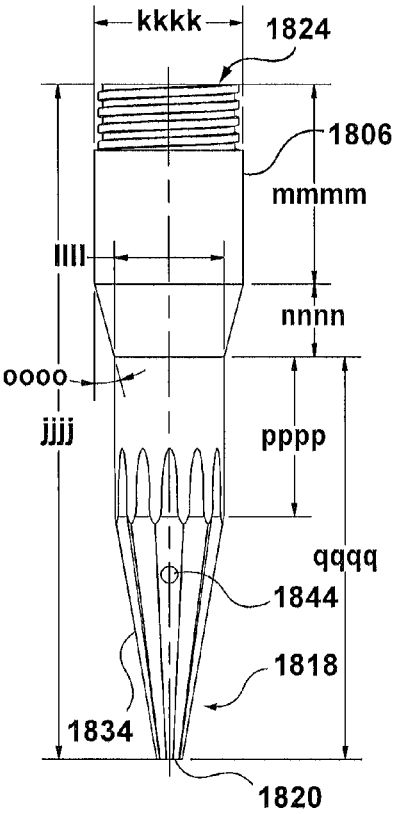
FIG. 21A is a side elevation view of a base portion of the pole base of FIG. 18A, without its guide posts.
Figure 21D:
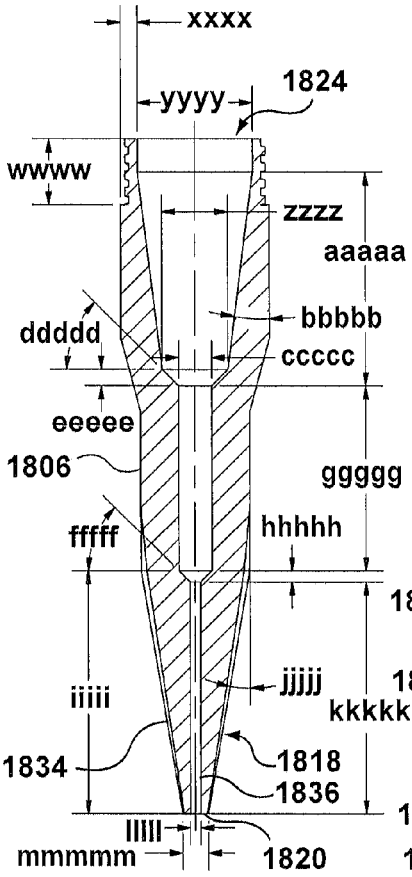
FIG. 21D is a side cross-sectional view of the base portion of FIG. 21A, taken along the line 21D-21D in FIG. 21C.
Figure 21E:
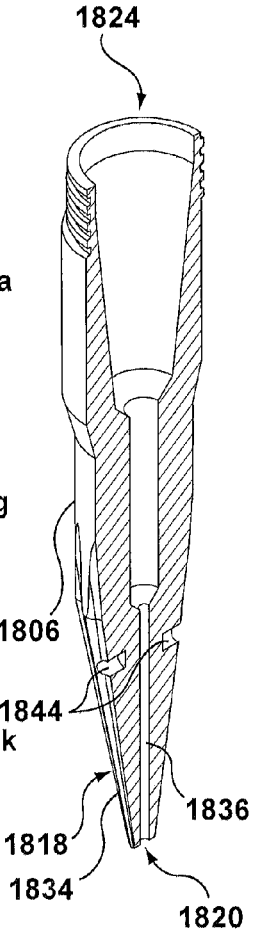
FIG. 21E is a top perspective cross-sectional view of the base portion of FIG. 21A.
Figure 21C:
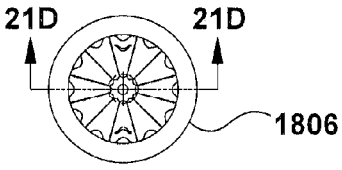
FIG. 21C is a bottom plan view of the base portion of FIG. 21A.

As noted above, other techniques besides welding may be used for securing the tubular extension to the base portion to form a complete pole base. FIGS. 18A to 21C show a second exemplary embodiment of a pole base 1804 formed from a base portion 1806 and a hollow tubular extension 1808. The second exemplary pole base 1804 is similar to the first exemplary pole base 104, with corresponding reference numerals used for corresponding features except with the prefix "18" instead of "1". The base portion 1806 and tubular extension 1808 shown in FIGS. 18A to 21C differ from the base portion 106 and tubular extension 108 shown in FIGS. 1 to 6C and 8A to 8C in that the base portion 1806 and tubular extension 1808 shown in FIGS. 18A to 21C are secured to one another by threaded interengagement rather than by welding. In particular, the inferior end 1812 of the tubular extension 1808 is internally threaded (see FIGS. 20D and 20E) and the superior end 1814 of the base portion 106 is correspondingly externally threaded (see FIGS. 18A and 21A to 21D) so that the two parts can be secured to one another to form a complete pole base 1804, as shown in FIGS. 18B and 19). The tubular extension 1808 shown in FIGS. 18A to 20E also differs from the tubular extension 108 shown in FIGS. 1 to 4E in that the tubular extension 1808 shown in FIGS. 18A to 20E does not have a thumbscrew nut; instead the thumbscrew aperture 1830 is internally threaded to receive the thumbscrew (not shown in FIGS. 18A to 20E).

Additional techniques for securing the tubular extension to the base portion, besides welding and threading, may also be used.

Figure 22:
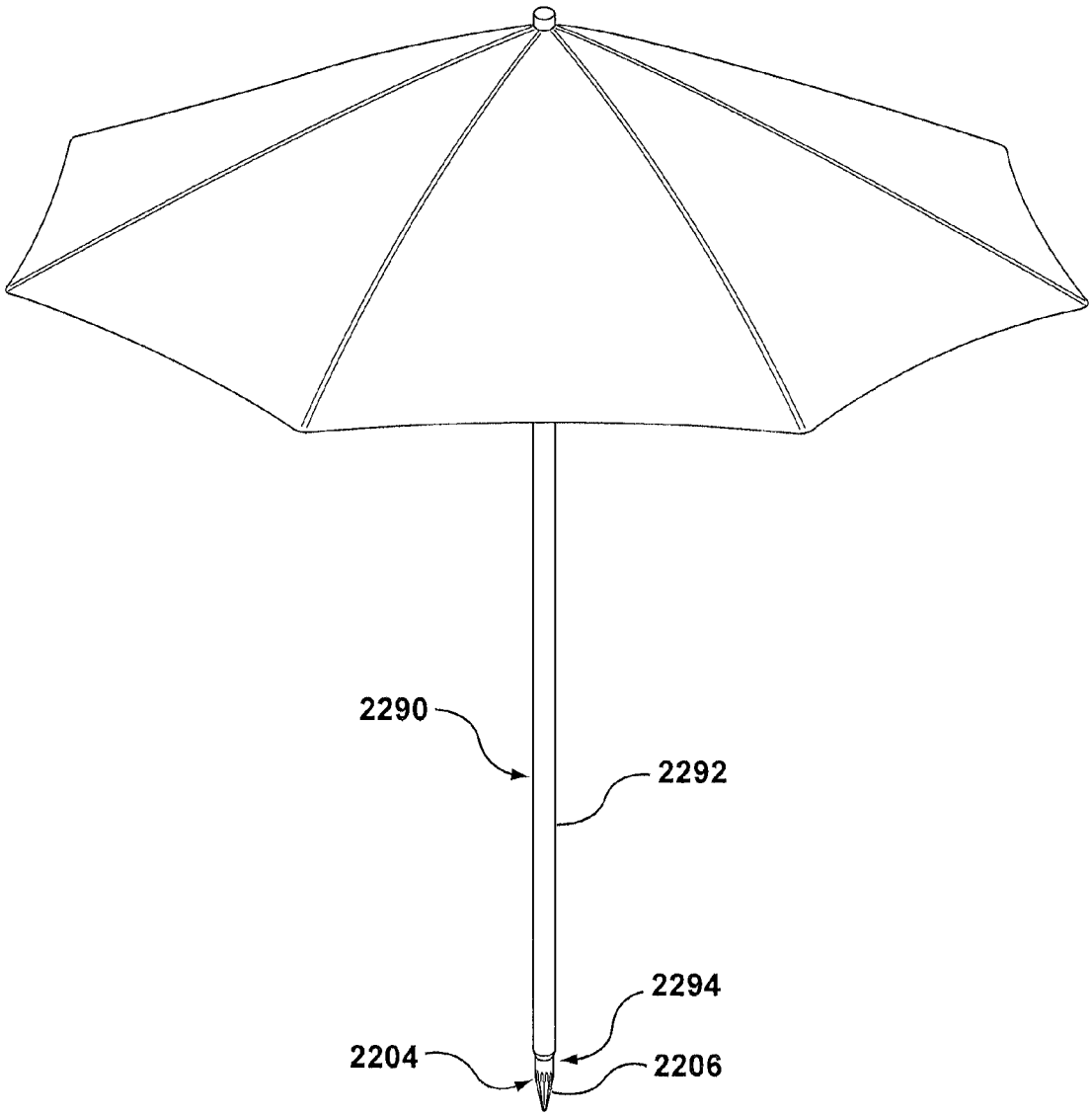
FIG. 22 is a perspective view showing an umbrella whose pole has an integral pole base including a base portion.

Both of the pole bases 104, 1804 described above include a receptacle 126, 1826 formed by the open receiving end 124, 1824 of the tubular extension 108, 1808 to receive the end of a pole. In other embodiments, a pole may be provided with an integral pole base whose base portion is similar in structure to the base portions 106, 1806 described above. FIG. 22 shows an exemplary pole 2290, in this case an umbrella pole, which comprises a shaft 2292 having at a mounting end 2294 thereof a base portion 2206 adapted for interengagement with a support mounting 102 as described above; the base portion 2206 and the mounting end 2294 of the shaft 2292 together form a pole base 2204, which in turn forms part of the pole 2290. The base portion 2206 may be, for example, an instance of the first exemplary base portion 106 that is welded to the mounting end 2294 of the shaft 2292, or an instance of the second exemplary base portion 1806 that is threadedly received within internal threads (not shown) at the mounting end 2294 of the shaft 2292. Alternatively, the base portion 2206 and the shaft 2292 may be integrally formed as a monolithic structure.

Throughout the Figures, reference letters have been used to denote various dimensions for exemplary embodiments. The chart below sets out the corresponding approximate numerical dimensions of the exemplary embodiments, in inches unless otherwise indicated. These dimensions are merely exemplary, and no limitation is implied.

| Reference Letter | Dimension |
|---|---|
| a | 19.250 |
| b | 9.000 |
| c | 0.635 |
| d | 0.550 |
| e | 9.000 |
| f | 0.313 |
| g | 0.500 |
| h | 0.188 |
| i | 0.175 (diameter) |
| j | 2.000 |
| k | 10.250 |
| l | 2.000 |
| m | 1.663 |
| n | 15 degrees |
| o | 0.125 (radius) |
| p | 3.500 |
| q | 0.636 |
| r | 2.431 |
| s | 6.115 |
| t | 3.000 |

-continued

| Reference Letter | Dimension |
|---|---|
| u | 1.750 (diameter) |
| v | 1.000 (diameter) |
| w | 0.250 |
| x | 0.500 (diameter) |
| y | 0.250 |
| z | 2.816 |
| aa | 0.172 |
| bb | 0.882 |
| cc | 0.100 (radius) |
| dd | 0.298 |
| ee | 0.156 (diameter) |
| ff | 0.389 |
| gg | 0.600 |
| hh | 0.250 (diameter) |
| ii | 1.750 (diameter) |
| jj | 0.723 (minor radius) |
| kk | 0.832 (major radius) |
| ll | 0.139 (radius) |
| mm | 0.093 (radius) |
| nn | 0.175 (minor radius) |
| oo | 0.200 (major radius) |
| pp | 0.033 (radius) |
| qq | 0.024 (radius) |
| rr | 4.500 |
| ss | 2.000 (diameter) |
| tt | 1.900 |
| uu | 130 degrees |
| vv | 1.38 (diameter) |
| ww | 0.328 |
| xx | 0.050 |
| yy | 0.050 |
| zz | 1.128 |
| aaa | 0.256 (diameter) |
| bbb | 0.130 (radius) |
| ccc | 1.128 |
| ddd | 1.000 |
| eee | 0.800 |
| fff | 8 degrees |
| ggg | 42 degrees |
| hhh | 0.130 (radius) |
| iii | 0.200 (radius) |
| jjj | 2.500 (diameter) |
| kkk | 2.170 diameter) |
| lll | 0.250 |
| mmm | 2.250 |
| nnn | 2.000 |
| ooo | 1.000 |
| ppp | 1.500 |
| qqq | 0.750 |
| rrr | 0.500 |
| sss | 0.500 |
| ttt | 0.750 |
| uuu | 0.750 |
| vvv | 0.790 |
| www | 0.040 |
| xxx | 0.040 |
| yyy | 0.040 |
| zzz | 2.500 (diameter) |
| aaaa | 2.170 (diameter) |
| bbbb | 0.750 |
| cccc | 2.250 (diameter) |
| dddd | 2.250 (diameter) |
| eeee | 19.250 |
| ffff | 10.000 |
| gggg | 9.250 |
| hhhh | 0.500 |
| iiii | 1.000 |
| jjjj | 10.250 |
| kkkk | 2.250 |
| llll | 1.663 |
| mmmm | 3.028 |
| nnnn | 1.107 |
| oooo | 15 degrees |
| pppp | 2.431 |
| qqqq | 6.115 |
| rrrr | 2.250 (diameter) |
| ssss | 0.156 (diameter) |

-continued

| Reference Letter | Dimension |
|---|---|
| tttt | 0.500 (diameter) |
| uuuu | 1.750 (diameter) |
| vvvv | 1.000 (diameter) |
| wwww | 1.000 |
| xxxx | 0.250 |
| yyyy | 1.750 |
| zzzz | 1.000 |
| aaaaa | 3.250 |
| bbbbb | 7 degrees |
| ccccc | 0.500 |
| ddddd | 45 degrees |
| eeeee | 0.250 |
| fffff | 45 degrees |
| ggggg | 2.816 |
| hhhhh | 0.172 |
| iiiii | 3.684 |
| jjjjj | 10 degrees |
| kkkkk | 3.513 |
| lllll | 0.156 |
| mmmmm | 0.400 |

The table below sets out a listing of the reference numerals used herein, as well as the part or feature identified by that reference numeral, for ease of reference. No limitation is implied by this table.

| Reference | Part/Feature Description |
|---|---|
| 100 | Pole mounting system (generally) |
| 102 | Support mounting |
| 104 | First exemplary pole base |
| 106 | Base portion of first exemplary pole base |
| 108 | Hollow tubular extension of pole base |
| 110 | Pole |
| 112 | Inferior end of tubular extension of first exemplary pole base |
| 114 | Superior end of tubular extension of first exemplary pole base |
| 116 | Guide posts of first exemplary pole base |
| 118 | Inferior end/insertion end of base portion of first exemplary pole base |
| 120 | Tip of insertion end of first exemplary pole base |
| 124 | Receiving end of tubular extension of first exemplary pole base |
| 126 | Receptacle in pole base of first exemplary pole base |
| 128 | Thumbscrew of first exemplary pole base |
| 130 | Thumbscrew aperture of first exemplary pole base |
| 132 | Thumbscrew nut of first exemplary pole base |
| 134 | Outer surface of insertion end of base portion of first exemplary pole base |
| 136 | Drainage passage in base portion of first exemplary pole base |
| 138 | Cylindrical intermediate portion of base portion of first exemplary pole base |
| 142 | Rounded end of guide post |
| 144 | Holes in base portion of first exemplary pole base for guide posts |
| 150 | Cylindrical body of support mounting |
| 152 | Receiving aperture of support mounting |
| 154 | Superior end of support mounting |
| 156 | Receiving recess of support mounting |
| 158 | Distal end of receiving recess |
| 160 | Drainage passage in support mounting |
| 162 | Inferior end of cylindrical body of support mounting |
| 164 | Helical guide channels |
| 166 | Wall of receiving recess |
| 168 | Channel entrance of helical guide channel |
| 170 | Terminal reverse bend of helical guide channel |
| 172 | Distal end of helical guide channel |
| 174 | Outer edge of helical guide channel at elbow of reverse bend |
| 176 | Elbow of reverse bend |
| 178 | Lower edge of helical guide channel at elbow of reverse bend |

-continued

| Reference | Part/Feature Description |
|---|---|
| 180 | Shoulder formed by elbow of reverse bend |
| 182 | Terminus of reverse bend |
| 1200 | First exemplary receiver |
| 1202 | Generally planar bracket of first exemplary receiver |
| 1204 | Curved trough of bracket of first exemplary receiver |
| 1206 | Through holes in bracket of first exemplary receiver |
| 1300 | Second exemplary receiver |
| 1302 | Generally L-shaped corner bracket of second exemplary receiver |
| 1304 | Curved trough of bracket of second exemplary receiver |
| 1306 | Through holes in bracket of second exemplary receiver |
| 1408 | Collar |
| 1410 | Umbrella aperture in deck |
| 1412 | Deck |
| 1414 | Tubular body of collar |
| 1416 | Outwardly projecting annular flange of collar |
| 1510 | Umbrella aperture in deck |
| 1512 | Deck |
| 1518 | Bolts |
| 1720 | Concrete |
| 1804 | Second exemplary pole base |
| 1806 | Base portion of second exemplary pole base |
| 1808 | Hollow tubular extension of second exemplary pole base |
| 1812 | Inferior end of tubular extension of second exemplary pole base |
| 1814 | Superior end of tubular extension of second exemplary pole base |
| 1816 | Guide posts of second exemplary pole base |
| 1818 | Inferior end/insertion end of base portion of second exemplary pole base |
| 1820 | Tip of insertion end of second exemplary pole base |
| 1824 | Receiving end of pole base of second exemplary pole base |
| 1826 | Receptacle in pole base of second exemplary pole base |
| 1830 | Thumbscrew aperture of second exemplary pole base |
| 1834 | Outer surface of insertion end of base portion of second exemplary pole base |
| 1838 | Cylindrical intermediate portion of base portion of second exemplary pole base |
| 1836 | Drainage passage in base portion of second exemplary pole base |
| 1844 | Holes in base portion of second exemplary pole base for guide posts |
| 2204 | Pole base of umbrella pole |
| 2206 | Base portion on shaft of umbrella pole |
| 2290 | Umbrella pole |
| 2292 | Shaft of umbrella pole |
| 2294 | Mounting end of shaft of umbrella pole |

Although illustrated embodiments have been described above in the context of deck and patio umbrellas, this is merely one exemplary context in which pole mounting systems as described herein may be employed. Pole mounting systems as described herein may be used in other contexts, for example for the removable mounting of fence posts, sports equipment such as basketball nets and soccer goals, posts for supporting cameras or other observation equipment, as well as other types of posts.

Several currently preferred embodiments have been described by way of example. It will be apparent to persons skilled in the art that a number of variations and modifications can be made without departing from the scope of the claims.

What is claimed is:

1. A pole base, comprising:

an insertion end for insertion through a receiving aperture into a receiving recess in a body of a support mounting;

the insertion end tapering conically inwardly toward a tip of the insertion end;

the insertion end having at least one guide post extending laterally therefrom;

the at least one guide post having a fixed circumferential position on the insertion end along the conical taper;

wherein a pole extends from the pole base opposite the insertion end.

2. The pole base of claim 1, wherein the pole base forms part of the pole.

3. The pole base of claim 1, wherein the pole base has a receiving end opposite the insertion end, the receiving end having a receptacle for securely releasably receiving an end of the pole.

4. The pole base of claim 1, wherein the at least one guide post consists of two diametrically opposed guide posts.

5. The pole base of claim 1, wherein the insertion end is frusto-conical.

6. The pole base of claim 1, wherein an outer surface of the insertion end is longitudinally crenate.

7. The pole base of claim 1, wherein the insertion end has about a 10 degree longitudinal taper.

* * * * *